US005279372A

United States Patent [19]

Rinnemaa

[11] Patent Number: 5,279,372

[45] Date of Patent: Jan. 18, 1994

[54] METHOD OF DRILLING HOLES IN ROCK

[75] Inventor: Heikki Rinnemaa, Tampere, Finland

[73] Assignee: Tamrock Oy, Tampere, Finland

[21] Appl. No.: 30,436

[22] PCT Filed: Sep. 27, 1991

[86] PCT No.: PCT/FI91/00299

§ 371 Date: Mar. 29, 1993

§ 102(e) Date: Mar. 29, 1993

[87] PCT Pub. No.: WO92/06276

PCT Pub. Date: Apr. 16, 1992

[30] Foreign Application Priority Data

Oct. 8, 1990 [FI] Finland ..... 904938

[51] Int. Cl.[5] ..... E21B 7/00

[52] U.S. Cl. ..... 175/24

[58] Field of Search ..... 175/24, 25, 27, 57, 175/62

[56] References Cited

U.S. PATENT DOCUMENTS

| | | | |
|---|---|---|---|
| 3,906,726 | 9/1975 | Jameson | 175/24 |
| 4,343,367 | 8/1982 | Mashimo | 173/43 |
| 4,407,017 | 9/1983 | Zhilikov et al. | 175/24 X |
| 4,601,000 | 7/1986 | Montabert | 364/513 |
| 4,639,868 | 1/1987 | Tanaka et al. | 175/24 X |

FOREIGN PATENT DOCUMENTS

| | | |
|---|---|---|
| 67605 | 6/1976 | Finland . |
| 830008 | 7/1983 | Finland . |
| 853760 | 3/1987 | Finland . |
| 88425 | 5/1993 | Finland . |

*Primary Examiner*—Thuy M. Bui
*Attorney, Agent, or Firm*—Nixon & Vanderhye

[57] ABSTRACT

The invention relates to a method of drilling holes in rock. In the method, holed (4a–4n, 6a–6n) are drilled in the rock (5) in order to break it into a desired shape. To drill the holes, the drill bit of a rock drilling equipment is positioned successively at the starting points of the holes at the ends of the rows of holes (4a–4n, 6a–6n) to be drilled, and the starting points of the holes are stored in the memory of a control unit provided in the rock drilling equipment. The control unit then calculates the position of the other holes in the row of holes on the basis of the end holes (4a, 4n, 6a, 6n) of the row and drills the holes automatically on the basis of preset drilling parameters, such as direction and depth.

3 Claims, 1 Drawing Sheet

METHOD OF DRILLING HOLES IN ROCK

Figure 1A:
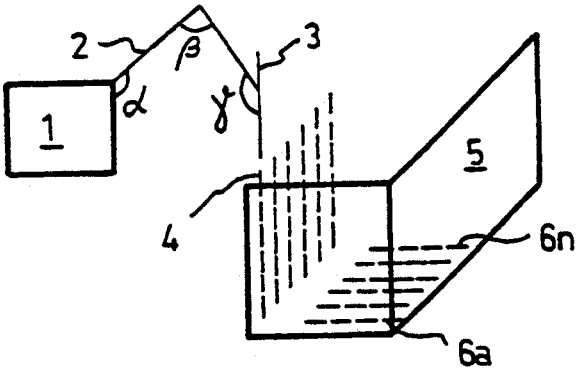

This invention relates to a method of drilling holes in rock according to a predetermined scheme in order to loosen blocks Of desired shape, wherein the holes are drilled by means of a rock drilling equipment comprising a carrier; a boom attached to the carrier turnably with respect to it; a feeding beam attached to the end of the boom, a drilling machine being arranged to move along the feeding beam during drilling; sensors for indicating the position of the feeding beam and the boom with respect to the carrier; and a control unit which calculates the position and drilling direction of a drill bit on the basis of the values measured by the sensors.

When drilling holes for quarrying stone for further processing in open pits, the purpose is to loosen stone in rectangular blocks of predetermined dimensions by drilling holes in a row in the rock in a predetermined direction, whereby the rock breaks along this row in blasting. Today such rows of holes are drilled by means of a so-called line drilling equipment comprising a long frame structure with one or more drilling machines. The drilling machines move in the longitudinal direction of the frame structure or the line beam in such a way that the drilled holes are always positioned in a straight line.

This kind of equipment is mechanically difficult to handle as it is heavy and a heavy lifting platform or transport means is needed to displace it in position in the drilling site. Furthermore, it is difficult and laborious to align the equipment to obtain a desired line of holes, and the alignment of the drilling machines in a desired plane of holes is difficult. In addition, the mechanics and structure of the present equipment depend on whether rows of holes or individual holes are to be drilled.

The object of the present invention is to provide a method by means of which both holes in a row and individual holes or hole fields can be drilled easily and simply with a light equipment which is easy to locate and align for drilling. The method according to the invention is characterized in that a row of holes is drilled by positioning the drill bit at the starting point of a hole to be positioned at one end of the row of holes; storing the starting point of the hole in the memory of the control unit On the basis of the position of the drill bit; displacing the drill bit to the starting point of the last hole in the row of holes; storing the starting point of the last hole in the memory of the control unit on the basis of the position of the drill bit; setting at least such drilling parameters as the direction and the number of the holes or a spacing between two adjacent holes in the control unit; whereby a calculating means in the control unit calculates the position of the starting points of the holes and, by means of the drilling parameters, the position of all of the holes with respect to the carrier, whereafter the rock drilling equipment drills the holes automatically on the basis of the calculated positional values and the preset parameters.

The basic idea of the invention is that a row or pattern of holes is determined in such a way that the drill bit is positioned at holes positioned at the ends of the rows of holes to be drilled by turning the boom and the feeding apparatus of the drilling equipment, and the position of each such hole with respect to the carrier of the equipment is determined on the basis of the position of the drill bit when it is positioned at the hole, whereafter the direction and depth of the holes to be drilled and the spacing of holes or the number of holes in a row are given, and an automatic control unit then calculates the direction and drilling depth of the boom and the feeding beam, and drills the holes in accordance with the given scheme. Correspondingly, for example, a field of holes with a predetermined spacing of holes both in the transverse and in the longitudinal direction can be determined by positioning the drill bit at holes to be positioned at the corners of the field and determining their position, and then similarly separately determining the position of each individual hole to be drilled by means of the drill bit, whereafter the equipment drills all the holes in accordance with a given hole direction and drilling depth.

An advantage of the method according to the invention is that the driller does not need to accurately align the holes, but he only guides the drill bit to a hole to be drilled while the equipment calculates the other required values automatically on the basis of the given parameters, and performs the drilling. A further advantage is that the drilling of holes in straight rows does not require separate frame structures difficult to use, but the drilling can be performed by using a light carrier the boom of which is guided in such a manner that the line drilling takes place in a desired manner. The control of the direction of the feeding beam and the alignment of the drilling process can be carried out especially easily and reliably by means of an equipment having guiding and controlling means such as disclosed in a parallel application filed simultaneously with the present application. In the parallel application, the guidance of the equipment is effected by dividing the guiding and controlling circuit in a way into two portions independent of each other. The first portion determines the position and movements of the carrier and the boom and measures and calculates the position, direction and inclination of the boom end close to the feeding beam, i.e. a reference point determined in the boom end. The second portion in turn adjusts the inclination of the feeding beam in such a way that the inclination of the feeding beam is determined in a fixed system of coordinates with respect to the reference point, whereby the inclination and longitudinal movements of the feeding beam are determined with respect to the system of coordinates in which the reference point is defined. By means of this embodiment the position of holes to be drilled can be determined in the most simple way by first positioning the feeding beam in the required drilling direction and substantially in the middle of its longitudinal travel length with respect to the end of the boom, whereby the height differences of the holes to be drilled with respect to a reference plane can be determined simply by means of the longitudinal movements of the feeding beam, while the position of the axis of the holes in the applied system of coordinates can be determined by varying the position of the end of the boom.

Figure 1B:
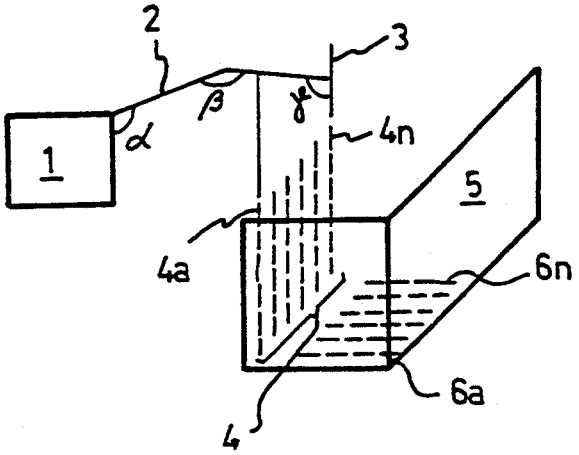
Figure 1C:
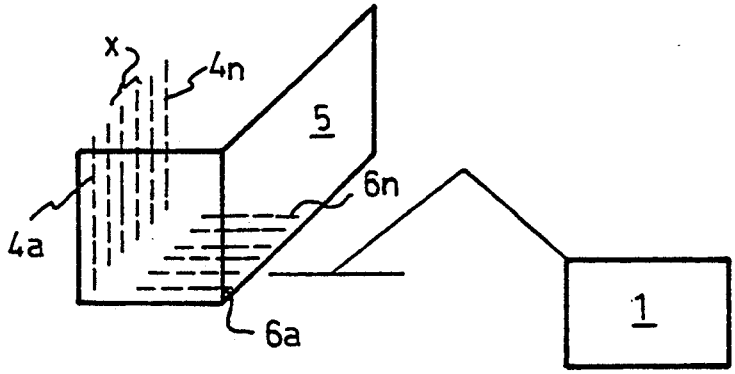
Figure 2:
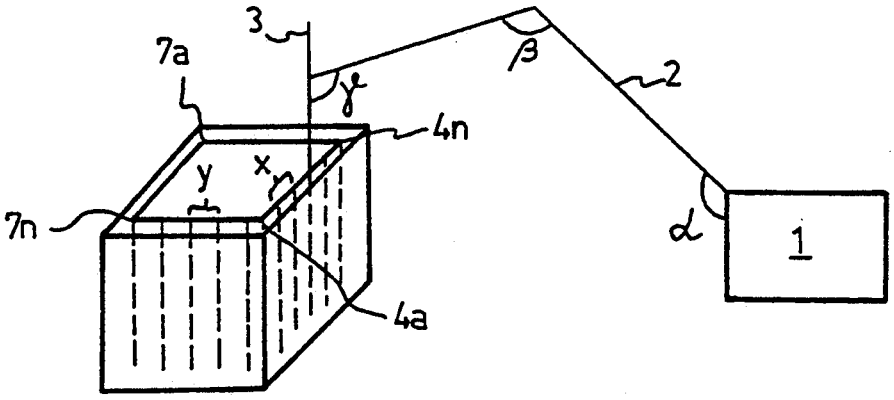

The invention will be described in greater detail with reference to the attached drawings, in which FIGS. 1*a* to 1*c* show schematically an application of the method according to the invention when drilling holes in a row; and FIG. 2 shows schematically an application of the method according to the invention when cutting a block of stone.

In FIGS. 1*a* to 1*c*, the purpose is to form rows of drill holes to loosen a block 5 out of a rock.

FIG. 1*a* shows a rock drilling equipment having a carrier 1 to which a boom 2 is connected. A feeding beam 3 along which a drilling machine moves in a manner known per se is connected to the end of the boom 2. The direction of the boom and the feeding beam and the position of a drill bit attached to the end of the feeding beam before drilling can be determined by means of boom angles $\alpha$, $\beta$ and $\gamma$ and the lengths of the boom 2 and the feeding beam 3. The measurement of the position of the boom by means of sensors provided in its joints and the geometry of the boom, that is, the distances between its joints, and the turning and rotation angles of the boom, is known per se and obvious to one skilled in the art e.g. on the basis of U.S. Pat. No. 4,514,796 or FR Patent 8200648, wherefore it will not be described in greater detail herein.

The values of the angles $\alpha$, $\beta$ and $\gamma$ and the position of the feeding beam with respect to the end of the boom in the longitudinal direction of the feeding beam and the displacing movement of the drilling machine with respect to the feeding beam are measured in a manner known per se by means of the sensors. Measuring values obtained by the sensors are applied to a control unit known per se provided in the rock drilling equipment so as to determine the position of the drill bit with respect to the carrier 1. In this case, the drill bit in its back position is guided to the starting point of a hole 4*a* in order to determine this starting point with respect to the carrier 1 of the drilling equipment. When the drill bit is at the starting point of the hole, the driller stores, in the memory of the control unit, the coordinate data determining the position of the hole 4*a* on the basis of the positions and dimensions of the boom and the feeding apparatus.

In FIG. 1*b*, the drill bit has been displaced from the position of FIG. 1*a* to the starting point of the last hole 4*n* in the row of holes 4, whereafter the driller again stores the positional data of the hole in the memory of the control unit. A spacing x or a number n of the holes and such drilling parameters as the direction of the holes and, if required, the drilling depth are then applied to the control unit, whereafter the control unit automatically calculates the position of the holes and drills the holes in a straight line from the hole 4*a* up to the hole 4*n* so that the driller needs to interfere with the operation with the drilling equipment only in case of malfunction or apparatus breakage.

After the drilling of the row of holes 4 has been completed, the equipment is displaced to a position shown in FIG. 1*c* so as to drill a row of holes under the block 5, whereby the position of the first hole 6*a* and the last hole 6*n* with respect to the carrier 1 is similarly determined with the drill bit by positioning it at the starting point of the first hole 6*a* and at the starting point of the last hole 6*n*. Thereafter the control unit again calculates the position and direction of the holes in accordance with the given parameters, and drills the row of holes automatically.

FIG. 2 shows how the determination can be utilized when a loose boulder is to be cut into a block of smaller size so as to give it a desired shape. In this case, the drill bit is first passed to the starting point of a hole 4*a* and its position is determined as shown in FIGS. 1*a* and 1*b*. Then the drill bit is displaced to the starting point of the hole 4*n*, and this is stored in the memory. Thereafter the drill bit is passed to the starting point of a hole 7*a* which is stored in the memory, and further to the starting point of a hole 7*n*, which is also stored in the memory. The control unit then calculates the position of the holes on the basis of spacings x and Y between two adjacent holes or on the basis of the number of holes in a predetermined direction, and drills, in accordance with the other given parameters such as the direction and depth, a perimeter of holes in the boulder, whereby the lines between each pair of two defined holes are drilled so as to obtain a rectangular pattern. In other words, the driller controls the drilling process so that the holes are drilled e.g. from the hole 4*a* to the hole 4*n* and further to the hole 7*a* and via the hole 7*n* back to the hole 4*a*. The drilling order may be different, whereby the control unit is instructed between which holes the lines of holes are to be drilled. Correspondingly, such a line of holes can be drilled in various ways according to the requirements and each line can be positioned in the boulder in a desired manner. In place of a rectangular drilling pattern, triangular, polygonal or rhomboidal patterns, for instance, can be used, and the position of holes to be positioned at the corners of each pattern is determined as described above, that is, by positioning the drilling bit at the starting point of each corner hole and storing the respective values in the memory of the control unit to calculate the position and direction of the rows of holes between the corners. When utilizing the control and guidance system mentioned above, in which the control of the movements and position of the boom and the control of the movements and position of the feeding beam take place in a way separately from each other, the determination of the position of the holes and the drilling depth can be carried out in such a manner that the feeding beam 3 is positioned in parallel with the axis of the drill hole and substantially in the middle of its travel length with respect to the end of the boom, whereafter the end of the boom 2 close to the feeding beam is turned substantially in the same plane to the first drill hole to be determined and the feeding beam 3 is pushed against the surface of the stone so as to determine the position of the starting point by means of coordinates contained in said plane and the length of the feeding beam from the end of the boom 2 to the drill bit. Correspondingly, in accordance with the above-described procedure, the value of the starting point of the hole is stored in the memory and the feeding beam 3 is displaced, if required, away from the surface of the rock in its longitudinal direction, whereafter the end of the boom 2 is displaced in the defined plane towards the following hole, until the feeding beam 3 can again be displaced in its longitudinal direction so that the drill bit is at the starting point of the hole. The starting point of this hole is then stored in the memory of the control unit on the basis of the position of the end of the boom and the distance between the drill bit and the end of the boom.

In some cases, it is necessary to drill holes positioned in a predetermined regular order e.g. in order to effect breaking along a line deviating from a straight line. It is thereby possible to perform the drilling by positioning the drill bit successively at each hole to be drilled and storing the starting points of the holes as described above, whereafter the equipment drills the holes in proper order in accordance with a desired direction and hole depth.

The invention has been described and shown in the above description and the attached drawings by way of example, and it is not restricted to the example in any way. Even though only one joint angle $\alpha$, $\beta$ and $\gamma$ and has been shown in the figures and referred to in the description with respect to the boom to illustrate the invention with an example as simple as possible, it is to be understood that in normal conditions and with conventional apparatus the boom has several directional angles both with respect to the carrier and the feeding beam, and possibly it also rotates around the longitudinal axis of one of its parts, as described in the above-mentioned U.S. Pat. No. 4,514,796 and FR Patent 8200648, and thus the invention can be applied to any drilling equipment comprising a carrier, a boom and a feeding beam.

I claim:

1. Method of drilling holes in rock according to a predetermined scheme in order to loosen blocks of desired shape, wherein the holes are drilled by means of a rock drilling equipment comprising a carrier (1); a boom (2) attached to the carrier turnably with respect to it; a feeding beam (3) attached to an end of the boom, a drilling machine being arranged to move along the feeding beam during drilling; sensors for indicating the position of the feeding beam (3) and the boom (2) with respect to the carrier (1); and a control unit which calculates the position and drilling direction of a drill bit on the basis of the values measured by the sensors, characterized in that a row of holes is drilled by positioning the drill bit at the starting point of a hole (4*a*; 6*a*; 7*a*) to be positioned at one end of the row of holes (4*a*–4*n*; 6*a*–6*n*; 7*a*–7*n*); storing the starting point of the hole (4*a*; 6*a*; 7*a*) in the memory of a control unit on the basis of the position of the drill bit; displacing the drill bit to the starting point of the last hole (4*n*; 6*n*; 7*n*) in the row of holes (4*a*–4*n*; 6*a*–6*n*; 7*a*–7*n*); storing the starting point of the last hole (4*n*; 6*n*; 7*n*) in the memory of the control unit on the basis of the position of the drill bit; setting at least such drilling parameters as the direction and the number of the holes (4*a*–4*n*; 6*a*–t*n*; 7*a*–7*n*) or a spacing (x) between two adjacent holes in the control unit; whereby a calculating means in the control unit calculates the position of the starting points of the holes (4*a*–4*n*; 6*a*–6*n*; 7*a*–7*n*) and, by means of the drilling parameters, the position of all of the holes (4*a*–4*n*; 6*a*–6*n*; 7*a*–7*n*) with respect to the carrier (1), whereafter the rock drilling equipment drills the holes (4*a*–4*n*; 6*a*–6*n*; 7*a*–7*n*) automatically on the basis of the calculated positional values and the preset parameters.

2. Method according to claim 1, characterized in that in order to loosen a block of stone of a desired shape, holes (4*a*, 4*n*; 6*a*, 6*n*; 7*a*, 7*n*) are determined at the corners of the desired block of stone by positioning the drill bit successively at the starting point of each corner hole (4*a*, 4*n*; 6*a*, 6*n*; 7*a*, 7*n*), storing the starting point of each hole in the memory of the control unit, determining the shape of the block as rows of holes (4*a*–4*n*; 6*a*–6*n*; 7*a*–7*n*) from one corner point to another, whereby the rock drilling equipment drills the holes automatically on the basis of the positional values of the holes (4*a*–4*n*; 4*n*–7*a*; 7*a*–7*n*; 7*n*–4*a*) in the rows of holes, calculated by the calculating means of the control unit, and the preset parameters.

3. Method according to claim 1 characterized in that the position of each hole (4*a*, 4*n*; 6*a*, 6*n*; 7*a*, 7*n*) to be determined is determined by positioning the feeding beam (3) first in parallel with the axis of the drill holes (4*a*, 4*n*; 6*a*, 6*n*; 7*a*, 7*n*) and substantially in the middle of its travel length with respect to the end of the boom (2) and by turning the boom (2) with respect to the carrier (1) in such a way that a drill rod in the feeding beam is in alignment with the axis of the hole to be determined, whereafter the feeding beam is displaced so that the drill bit makes contact with the stone at the starting point of the hole and the starting point of the hole is stored in the memory of the control unit by means of the position of the boom end and the distance of the drill bit from a reference point defined in the boom end.

* * * * *